US007333753B2

(12) United States Patent
Hart et al.

(10) Patent No.: US 7,333,753 B2
(45) Date of Patent: Feb. 19, 2008

(54) DEVELOPER HOUSING DESIGN WITH IMPROVED SUMP MASS VARIATION LATITUDE

(75) Inventors: Steven C. Hart, Webster, NY (US); Ajay Kumar, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 55 days.

(21) Appl. No.: 11/263,371

(22) Filed: Oct. 31, 2005

(65) Prior Publication Data

US 2007/0098448 A1 May 3, 2007

(51) Int. Cl.
*G03G 15/06* (2006.01)

(52) U.S. Cl. ..... 399/222; 399/252; 399/254; 399/256

(58) Field of Classification Search ..... 399/256
See application file for complete search history.

(56) References Cited

U.S. PATENT DOCUMENTS

| | | | | |
|---|---|---|---|---|
| 5,572,299 | A * | 11/1996 | Kato et al. | 399/256 |
| 6,281,961 | B1 * | 8/2001 | Sako et al. | 355/27 |
| 6,546,225 | B2 | 4/2003 | Wang | |
| 2002/0071697 | A1 * | 6/2002 | Fujimoto | 399/254 |

* cited by examiner

*Primary Examiner*—David M. Gray
*Assistant Examiner*—David A Blackshire
(74) *Attorney, Agent, or Firm*—Lloyd F. Bean, II

(57) ABSTRACT

A developer system for developing an image in an electrophotographic printing machine, including: a developer housing having a toner sump containing developer material; a magnetic development member rotatably mounted in the housing for transferring toner particles to a latent image on the photoreceptive member in a development zone; a transport system for transporting developer material from the toner sump to the magnetic development member, the transport system includes: a mix/pump auger, disposed in a first auger channel, for mixing and circulating developer material along a first path within the first auger channel; a transport auger, adjacent to the mix/pump auger and disposed in a second auger channel, for circulating developer material along a second path within the second auger channel; a wall member disposed in between the mix/pump auger and the transport auger, the wall member having a first opening disposed near an inboard end of the housing and a second opening disposed near an outboard end of the housing, the first and second opening providing a recirculating path between the first and second paths; a pick up area define in the first path, the pick up area having a predefined developer material volume; and a third opening in the wall member, disposed adjacent to the pumping section associated with a pumping section of the mix/pump auger, for providing a spillway from the first path to the second path to allow excess developer material to be recirculated when the developer material volume of the pick up area is substantially full.

6 Claims, 7 Drawing Sheets

DEVELOPER HOUSING DESIGN WITH IMPROVED SUMP MASS VARIATION LATITUDE

CROSS-REFERENCE TO RELATED APPLICATION(S)

Reference is made to commonly-assigned copending U.S. patent application Ser. No. 11/263,370 filed concurrently herewith, entitled VARIABLE PITCH AUGER, by Steven C. Hart and Ajay Kamar, now U.S. Publication No. 20070098451; copending U. S. patent application Ser. No. 11/263,369, filed concurrently herewith, entitled XEROGRAPHIC DEVELOPER UNIT HAVING VARIABLE PITCH AUGER, by Steven C. Hart and Ajay Kamar now U.S. Publication No. 20070098450; copending U.S. patent application Ser. No. 11/262,577, filed concurrently herewith, entitled XEROGRAPHIC DEVELOPER UNIT HAVING MULTIPLE MAGNETIC BRUSH ROLLS WITH A GROOVED SURFACE, by Ajay Kumar, Keith A. Nau, David A. Reed, Jonathan D. Sadik, and Cory J. Winters, now U.S. Publication No. 20070098458; copending U.S. patent application Ser. No. 11/262,575, filed concurrently herewith, entitled XEROGRAPHIC DEVELOPER UNIT HAVING MULTIPLE MAGNETIC BRUSH ROLLS ROTATING AGAINST THE PHOTORECEPTOR, by Michael D. Thompson, James M. Chappell, Steven C. Hart, Patrick J, Howe, Ajay Kumar, Steven R. Leroy, Paul W. Morehouse, Jr., Palghat S. Ramesh, and Fei Xiao, now U.S. Publication No. 20070098456; and copending U.S. patent application Ser. No. 11/262,576, filed concurrently herewith, entitled XEROGRAPHIC DEVELOPER UNIT HAVING MULTIPLE MAGNETIC BRUSH ROLLS ROTATING WITH THE PHOTORECEPTOR, by James M. Chappell, Patrick J. Howe, Michael D. Thompson, and Fei Xiao. now U.S. Publication No. 20070098457, the disclosures of which are incorporated herein.

BACKGROUND

This invention relates generally to the development of electrostatic images, and more particularly concerns a development apparatus having developer housing design with improved sump mass variation latitude.

Generally, the process of electrophotographic printing includes sensitizing a photoconductive surface by charging it to a substantially uniform potential. The charge is selectively dissipated in accordance with a pattern of activating radiation corresponding to a desired image. The selective dissipation of the charge leaves a latent charge pattern that is developed by bringing a developer material into contact therewith. This process forms a toner powder image on the photoconductive surface which is subsequently transferred to a copy sheet. Finally, the powder image is heated to permanently affix it to the copy sheet in image configuration.

Two component and single component developer materials are commonly used. A typical two component developer material comprises magnetic carrier granules having toner particles adhering triboelectrically thereto. A single component developer material typically comprises toner particles having an electrostatic charge so that they will be attracted to, and adhere to, the latent image on the photoconductive surface.

There are various known development systems for bringing toner particles to a latent image on a photoconductive surface. Single component development systems use a donor roll for transporting charged toner to the development nip defined by the donor roll and the photoconductive surface. The toner is developed on the latent image recorded on the photoconductive surface by a combination of mechanical scavengeless development. A scavengeless development system uses a donor roll with a plurality of electrode wires closely spaced therefrom in the development zone. An AC voltage is applied to the wires detaching the toner from the donor roll and forming a toner powder cloud in the development zone. The electrostatic fields generated by the latent image attract toner from the toner cloud to develop the latent image.

In another type of scavengeless system, a magnetic developer roll attracts developer from a reservoir. The developer includes carrier and toner. The toner is attracted from the carrier to a donor roll. The donor roll then carries the toner into proximity with the latent image.

Two component developer housings need a uniform layer of developer material on the developer roll. This must be accomplished independent of sump mass variations, machine tilt, toner concentration, environmental conditions, etc. Traditionally, this means designing the magnetic "pick-up" function to acquire much more developer material than needed and then trimming off the excess. This approach does provide sufficient material to form a "full brush" over a limited range of adverse conditions. However, under nominal conditions, perhaps as much as 80% of the material initially acquired is trimmed off. This increases developer roll surface wear (because of the generally required very strong magnetic "pick-up" field), reduces developer material life, and wastes energy.

It is desirable to have a developer housing design that provides a constant flow (quantity) of developer material to the development nip region of a magnetic roll over a wide range of developer sump mass (volumes) (wider than traditional approaches).

SUMMARY

There is provided a housing that has three augers, upper transport, mixing pump, and lower front, and two magnetic developer rolls, upper and lower. The developer material used to perform the development function is "picked up" from the upper transport auger. In operation, above a minimum sump mass, the amount of material delivered by the pump section of the mixing pump auger to the upper transport auger is constant and independent of sump mass (volume). This is accomplished by over supplying material to the pump section and allowing the excess material to spill over into the lower front auger. The significance of this approach is that the amount of material available for "pick up" in the upper auger is constant. Having a constant "pick up" supply eliminates the need to over achieve the "pick up" function under nominal conditions, enabling the use of lower strength "pick up" magnetic fields. In turn, lower strength magnetics reduces the mechanical power required to drive the housing, enhances developer roll shell life, and should reduce developer material abuse. Thus, the housing has a constant developer material supply (MOR, MOS, compressed pile height (CPH), etc.) independent of sump mass variations (above a minimum level) and with lower power consumption, component wear, and material abuse.

DETAILED DESCRIPTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
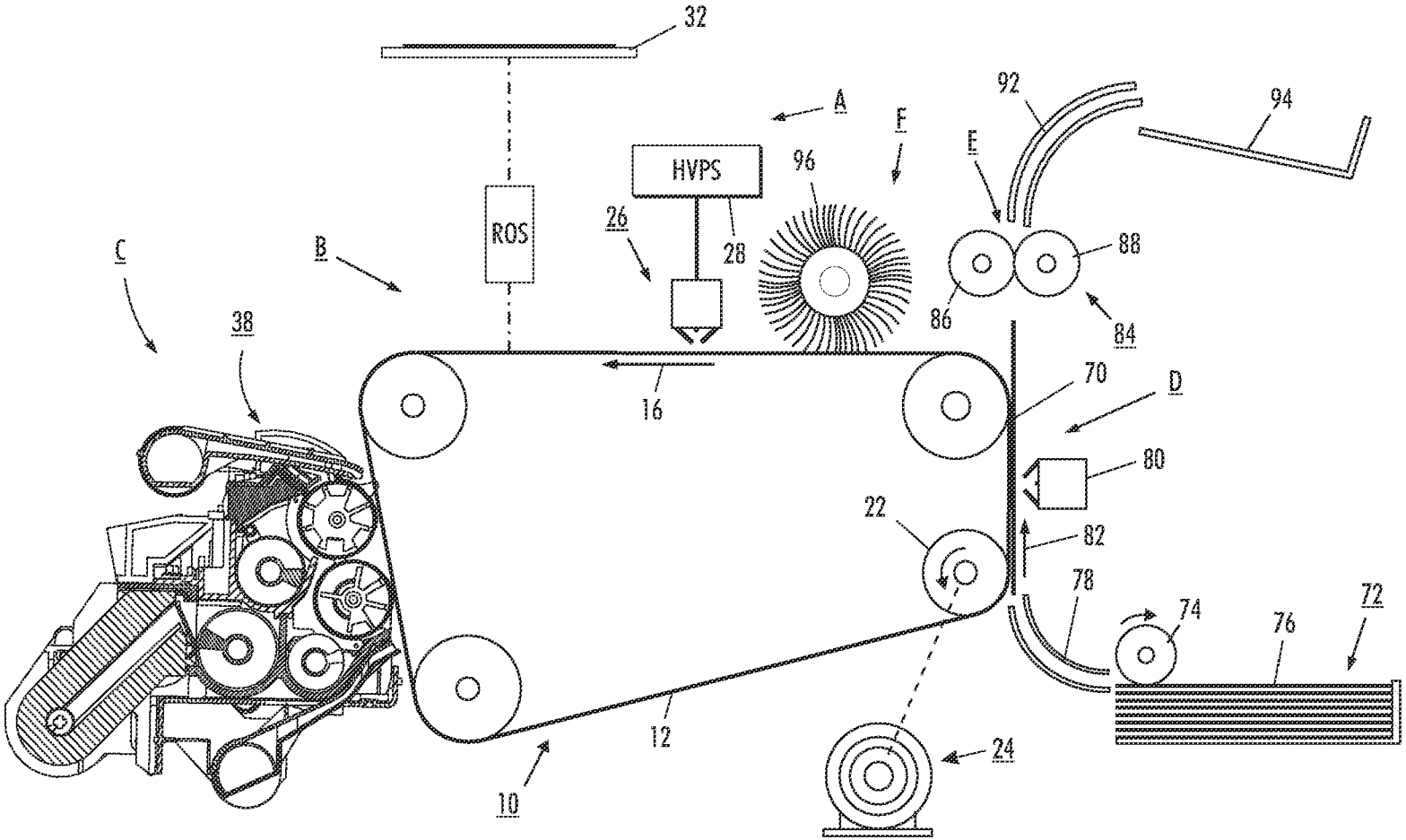
FIG. 1 is a schematic elevational view of an illustrative electrophotographic printing machine incorporating developer unit having the features of the present invention therein.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate. Belt 10 moves in the direction of arrow 16 to advance successive portions of photoconductive surface 12 sequentially through the various processing stations disposed of throughout the path of movement thereof. Motor 24 rotates belt 10 in the direction of arrow 16. Roller 22 is coupled to motor 24 by suitable means, such as a drive belt.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26 to charge photoconductive surface 12 of belt 10. After photoconductive surface 12 of belt 10 is charged, the charged portion thereof is advanced through exposure station B.

At exposure station B, a controller receives the image signals from Print Controller representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 36. Alternatively, the ROS 36 could be replaced by other xerographic exposure devices such as LED arrays.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Developer rolls 40 and 41 are mounted, at least partially, in the chamber of the developer housing. The chamber in the developer housing stores a supply of developer material. In one embodiment the developer material is a single component development material of toner particles, whereas in another, the developer material includes at least toner and carrier.

With continued reference to FIG. 1, after the electrostatic latent image is developed, belt 10 advances the toner powder image to transfer station D. A copy sheet 70 is advanced to transfer station D by sheet feeding apparatus 72. Preferably, sheet feeding apparatus 72 includes a feed roll 74 contacting the uppermost sheet of stack 76 into chute 78. Chute 78 directs the advancing sheet of support material into contact with photoconductive surface 12 of belt 10 in a timed sequence so that the toner powder image developed thereon contacts the advancing sheet at transfer station D. Transfer station D includes a corona generating device 80 which sprays ions onto the back side of sheet 70. This attracts the toner powder image from photoconductive surface 12 to sheet 70. After transfer, sheet 70 continues to move in the direction of arrow 82 onto a conveyor (not shown) that advances sheet 70 to fusing station E.

Fusing station E includes a fuser assembly, indicated generally by the reference numeral 84, which permanently affixes the transferred powder image to sheet 70. Fuser assembly 84 includes a heated fuser roller 86 and a back-up roller 88. Sheet 70 passes between fuser roller 86 and back-up roller 88 with the toner powder image contacting fuser roller 86. In this manner, the toner powder image is permanently affixed to sheet 70. After fusing, sheet 70 advances through chute 92 to catch tray 94 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 96 in contact with photoconductive surface 12. The particles are cleaned from photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present disclosure therein.

Figure 2:
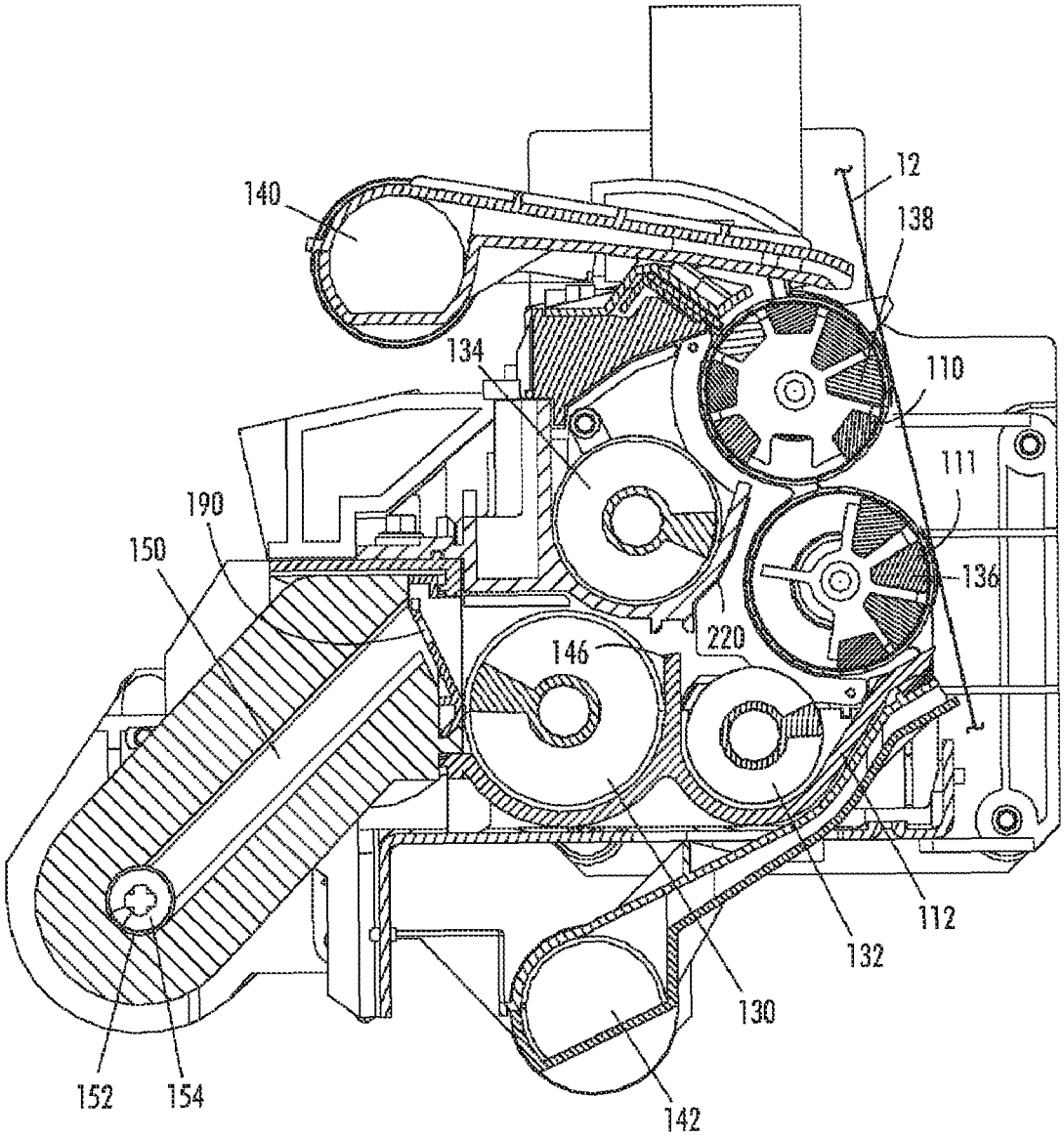
FIG. 2 is a schematic elevational view showing one embodiment of the developer unit used in the FIG. 1 printing machine.
Figure 3:
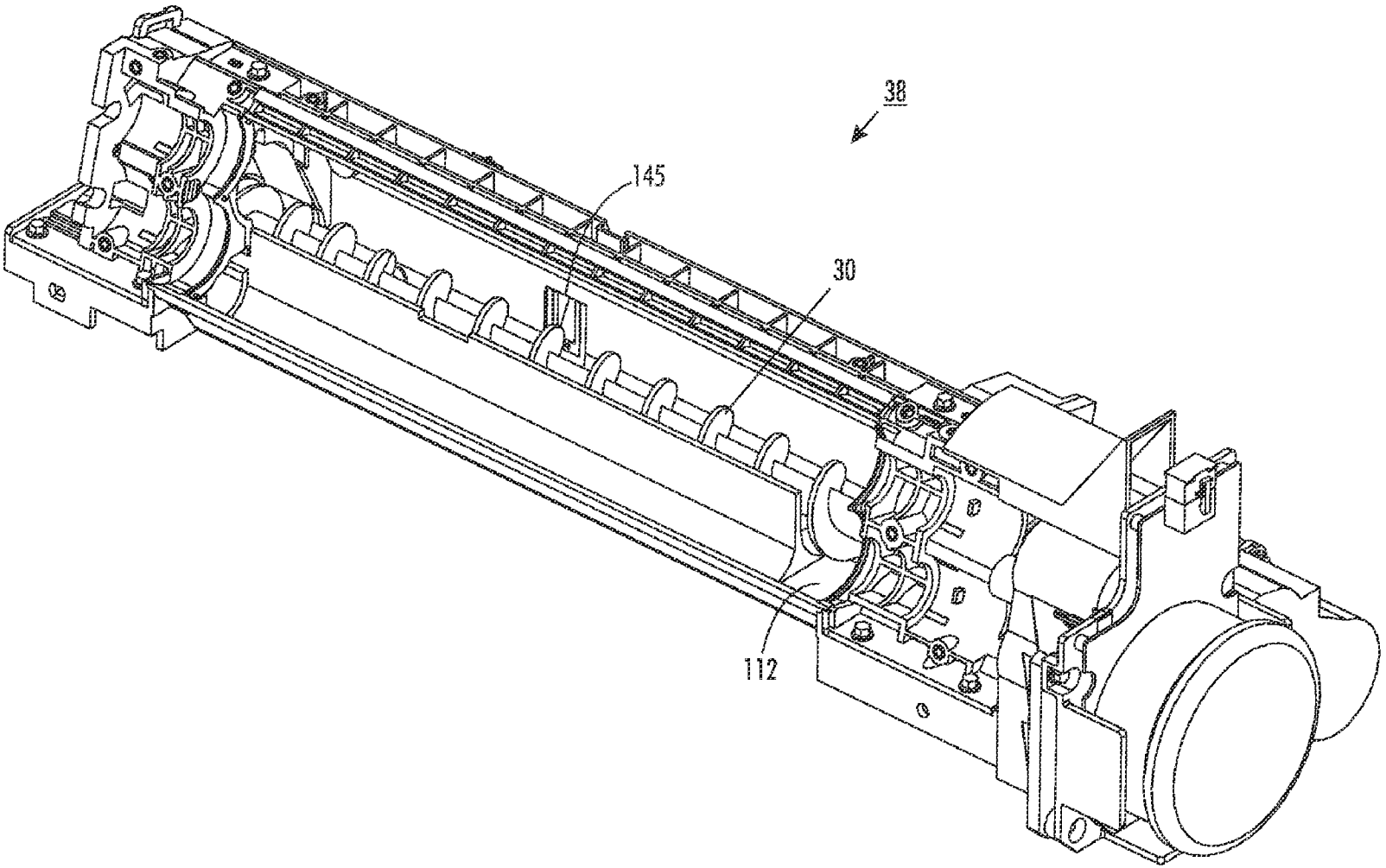
FIG. 3 is an illustration of the portion of the developer unit of the present disclosure.

Referring now to FIG. 2, there is shown an embodiment of the present disclosure in greater detail. The overall function of developer unit 100 is to apply marking material, such as toner, onto suitably-charged areas forming a latent image on an image receptor such as belt 10 (a portion of which is shown), in a manner generally known in the art. In various types of printers, there may be multiple such developer units, such as one for each primary color or other purpose.

Among the elements of a the developer unit shown in FIG. 2, which are typical of developer units of various types, are a housing 112, which functions generally to hold a supply of developer material, as well as augers such as 130, 132, 134, which variously mix and convey the developer material, and magnetic development rolls 136, 138, which in this embodiment form magnetic brushes to apply developer material to the belt 10.

For the illustrated embodiment wherein the magnetic development rolls 136, 138, are a relatively rigid cylinder, disposed within each magnetic development rolls 136, 138 there is a stationary "magnetic structure" 110, 111. The magnetic structure 110, 111 is designed to remain in one position while the magnetic development roll rotates around it. The magnetic structure 110, 111 includes any number of magnetic members as necessary, and these magnetic members may be in the form of discrete metal magnets, or areas of specific magnetic polarity within a continuous structure, such as in a "plastic magnet." Conceivably, the magnetic structure 110, 111 may comprise electromagnets as well. The purpose of the magnetic structure 110, 111 within magnetic development rolls 136, 138 are to guide the attraction of the magnetic carrier from the developer supply and cause the magnetic carrier to magnetically adhere to the surface of the magnetic development roll as a given portion of the surface of magnetic development roll is advanced, with motion of magnetic development roll, towards the development zone. As is well-known in the art of xerography, two-component developer generally functions as follows: the carrier particles, or beads, attracted by the magnets within magnetic structure 110, 111, form filaments of a "magnetic brush", particularly around the poles defined in the magnetic structure, much in the manner of iron filings. Adhering triboelectrically to the carrier beads is any number of toner particles. The magnetic brush of carrier beads thus serves to convey the toner particles to the development zone. In a typical two-component contact developing system, the magnetic brush with toner particles thereon is brought into direct contact with the surface 12 of the belt 10, to develop the latent image thereon.

Other types of features for development of latent images, such as developer rolls, paddles, scavengeless-development electrodes, commutators, etc., are known in the art and could be used in conjunction with various embodiments pursuant to the claims. In the illustrated embodiment, there is further provided air manifolds 140, 142, attached to vacuum sources (not shown) for removing dirt and excess particles from the transfer zone near belt 10. As mentioned above, in many embodiments of developer unit, a two-component developer material is used, comprising toner and carrier; the carrier particles are generally not applied to the belt 10, but rather remain circulating within housing 112.

In "trickle" type development systems as described above, but also in other types of developer unit, there is provided what can be called an "exit port", here indicated as 190, for the exit of excess or waste developer material from housing 112 for various reasons, such as to maintain a desired toner-to-carrier ratio or sump mass level. In the present embodiment, the exit port 90 is disposed near an auger 130, and communicates with an exit tube 150 which conveys waste developer to an output tube 152 which in turn includes a conveying auger 154 to convey, in this embodiment, the waste toner to a waste receptacle (not shown).

Figure 4:
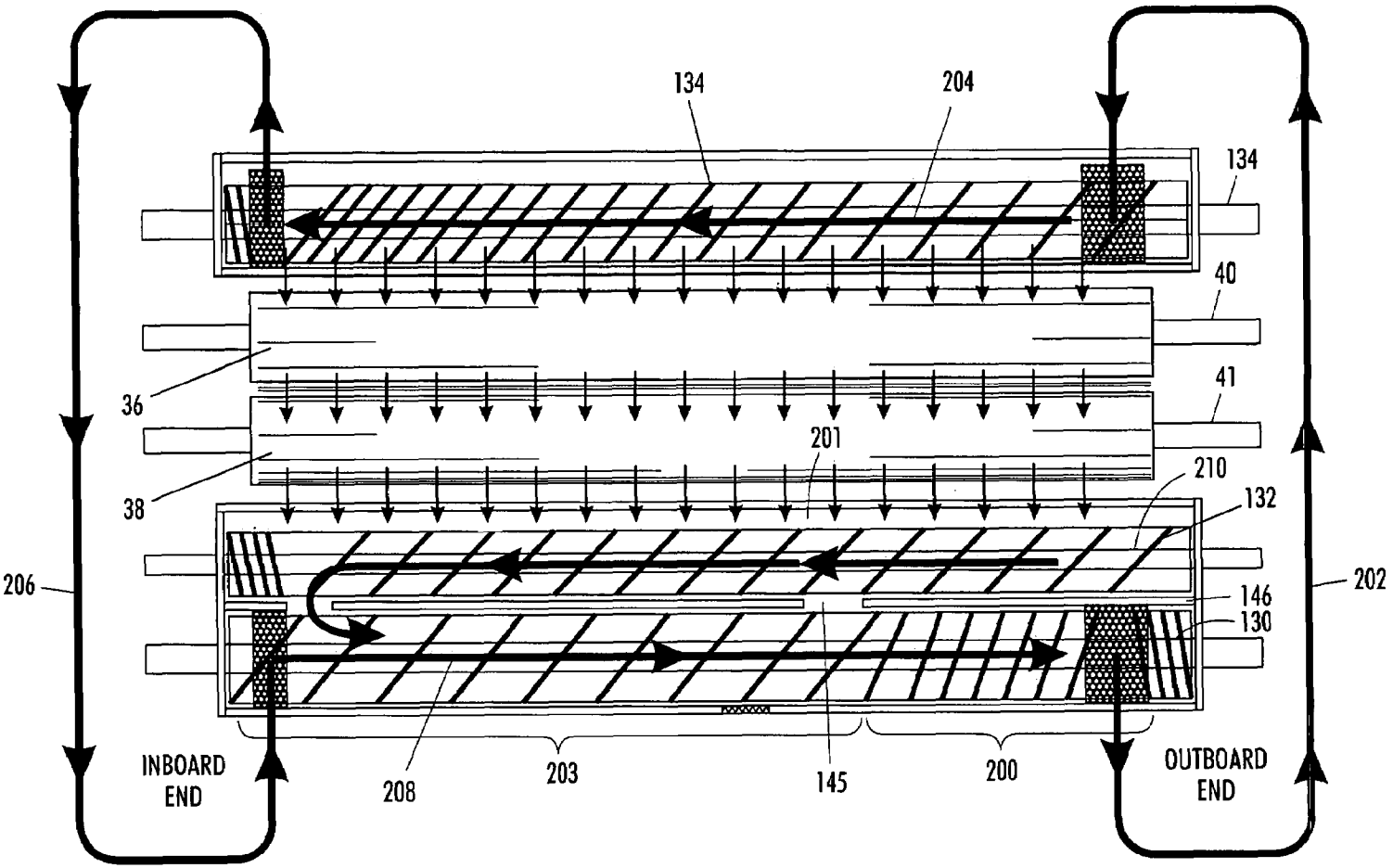
FIGS. 4 and 5 illustrate developer material flow patterns in developer unit used in FIG. 2.
Figure 5:
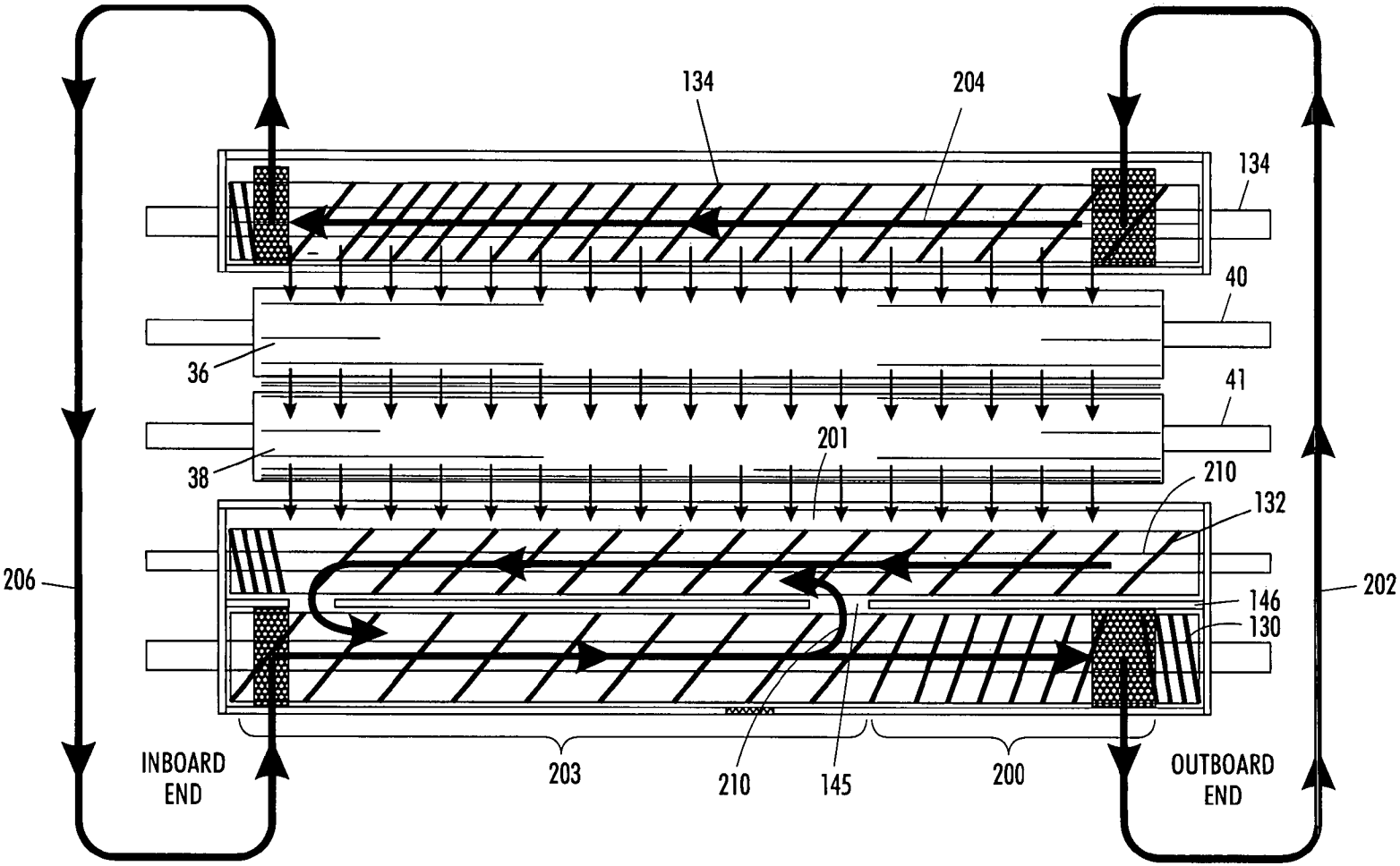
Figure 6:
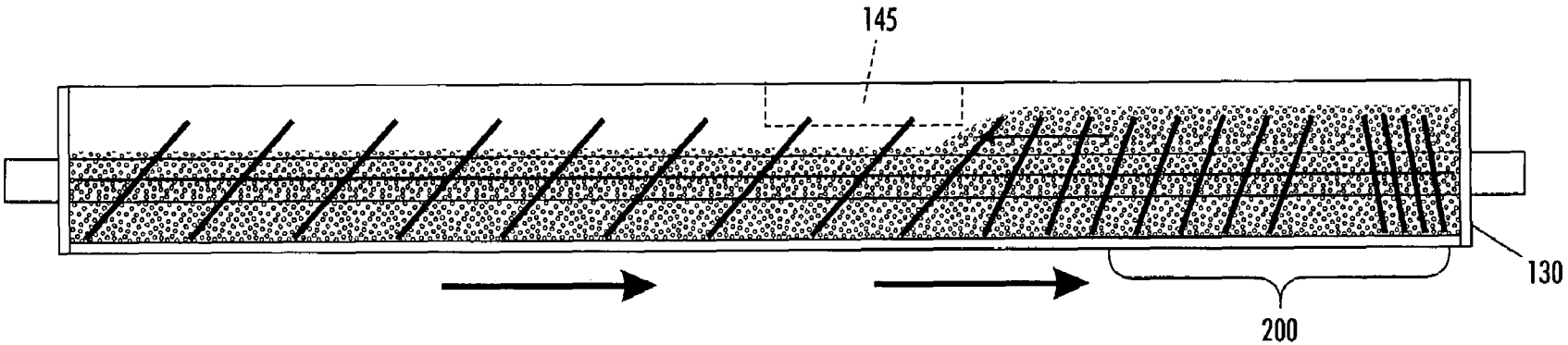
FIG. 6 is a side view illustrating the developer material flowing in the auger 130 of developer unit used in FIG. 2.

FIGS. 4-6 are diagrams for the developer material flow pattern in the housing. The diagrams are topologically correct. The inboard to outboard placement of the features is relationally correct. The location of the "pick up", trim, handoff, and development functions are logically correct. For the actual placement of the various components/features, please refer to FIG. 2. Auger 134 is an upper transport auger located in auger channel 220. Auger 134 may have variable pitch as disclosed in U.S. application Ser. No. 11/263,370, now U.S. Publication No. 20070098451 hereby incorporated by reference. Mixing/pump auger 130 and transport auger 132 are located below auger 134 and are disposed in auger channel 224 and auger channel 226. Auger 134 receives developer material from the pump section 200 of the mixing/pump auger 130 and developer material moves along portion 202 of the developer material flow pattern. The auger 134 then transports this material from outboard to inboard along the full length of the housing along portion 204 of the developer material flow pattern. The upper developer roll 40 "picks up" material from auger 134 for use in the development process. Any material that is not "picked up" and used to develop the image is ultimately dropped back down into the mixing/pump auger 130 (as illustrated by the downward arrows) at the inboard end of the developer housing along portion 206 of the developer material flow pattern.

Now focusing on the developer material, the developer material flows in the lower portion of the housing, spillway 145 is located at an opening near the top of the wall 146 separating the mixing pump auger 130 from the lower front auger 132. It is located just before the junction between the mixing section 203 and pump section 200 of the mixing pump auger 130. Spillway 145 is an opening defined in wall 146 and acts as a pressure relief vent; if more material is delivered to the pump section 200 of the mixing pump auger 130 than the pump can utilize, the excess material spills over the wall 146 and into the lower front auger 132.

The mixing pump auger 130 has several functions. It a) transports material from inboard to outboard along the developer material flow pattern 208, as shown in FIG. 4, *b*) mixes in the replenisher (replacement toner and carrier) supply delivered at the inboard end, c) pumps developer material up to the upper transport auger 135, and d) acts as part of the material mass (volume) buffer to accommodate changes in developer sump charge mass (volume). Auger 130 has been designed with a larger pitch to diameter ratio (P/D) preferably by a factor of 2 in the mixing transport section 203 than in the pump section 200. Transport rate is the physical displacement of material per unit time. It is expressed in units of mm/sec or units of mm/rev of the auger. Volumetric flow is the volume of developer material cross in our imaginary plane per unit time. In an auger this is equal to the "Transport rate" times the cross sectional area of the filled portion of the auger (channel).

The ramification of this is that at equal volumetric filling factors, the transport rate of material in the mixing section 203 is twice the rate of material transport in the pump section 200. Thus, when the pump section 200 is completely full, the transport section 203 needs only be half full to maintain a full condition in the pump section. Once the pump section is completely full, further increases in material delivery to the pump section will not change the amount of material pumped up to the upper transport auger 134. Applicants have found that as P/D goes to zero the transport rate also goes to zero as the P/D starts to exceed a 1.2 transport rate starts to drop off due to lack of efficiency and onset of rotating material around auger shaft. Applicants have found a useful P/D of the mixing transport to be about 1.2 to 0.2 but preferably 0.8 to 1.1. It should be noted that pitch/diameter ratio of the blades in the mix section and pump section can be varied stepwise or varied continuously.

If there is more material in the developer housing than is needed to maintain a full pump section 200, this material will accumulate in both the mixing section 203 of the mixing pump auger 130 and in the lower front auger 132. This in turn will result in the mixing section 203 delivering more material to the pump section 200 than the pump section 200 can utilize. The excess material that the pump section 200 cannot utilize falls over the spillway 145 as it "overflows" into the lower front auger 132, as illustrated as flow pattern 210 shown in FIG. 5.

Lower front auger 132 transports material from outboard to inboard along portion 210 of the developer material flow pattern. Auger 132 receives material at the overflow spillway from the mixing pump auger 130 and also receives material uniformly all along its length from the (lower) developer roll 41. When the material reaches the inboard end, it is delivered into the mixing pump auger 132.

With the above understanding of the elements and their organization of the system will be readily understood and appreciated from the following description. Starting with an empty housing, as developer material is (slowly) added to the developer housing, there occurs a specific mass (volume) level, at which the pump section of the auger becomes completely full.

Just as this occurs there is: A) no material "overflowing" over the "spillway" into the lower front auger, B) the mixing section of the mixing/pump auger is only partially full (i.e. on the order of 50%), and C) the pump section is pumping at maximum capacity (the pump section is completely full and is volumetrically plug flow rate limited as illustrated in FIG. 6. As further mass (volume) is added, the increase in mass (volume) causes 1) the amount/level of material in the mixing section of the mixing pump auger to increase, 2) excess material transported by the mixing section to go over the "spillway", and 3) the filling factor of the lower front auger to increase.

Figure 7:
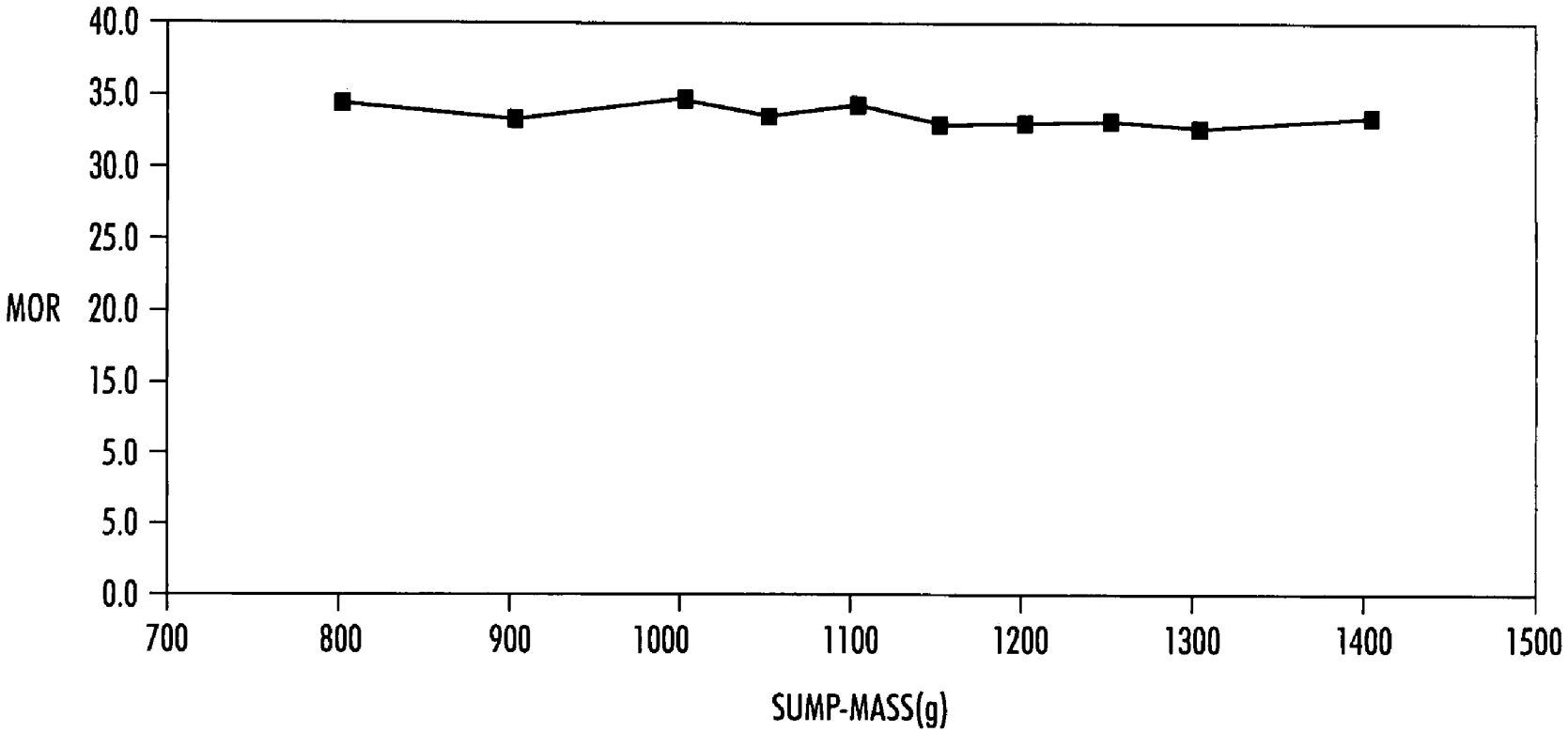
FIG. 7 is experimental data.

Yet there is no change in the amount of material delivered to the upper transport auger or to the pickup region of the magnetic roll or in the mass on the roll (MOR) after trim because the pump section was already pumping at maximum capacity. Mass (volume) can be added to the housing until the housing becomes too full without affecting the MOR. Data showing this behavior is shown in FIG. 7. The housing eventually will become too full due to either the lower front auger reaching 100% filling factor or the mixing transport section of the mixing pump auger reaching 100% filling factor. Preferably, this is approximately an incremental 50% after material starts going over the spillway. Hence the system which provides constant developer material mass on roll independent in changes in sump mass (volume) (once a minimum sump mass is achieved). This same behavior will also occur independent of housing tilt, provided that there is sufficient material to keep the pump section fully primed and material spilling over the spillway.

It is, therefore, apparent that there has been provided in accordance with the present invention that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A developer system having a housing, comprising:

a toner sump containing a first predefined volume of developer material;

a first auger, disposed in a first auger channel, for mixing and circulating developer material along a first path within said first auger channel said first auger having a pumping section;

a second auger, adjacent to said first auger and disposed in a second auger channel, for circulating developer material along a second path within said second auger channel;

a wall member disposed in between said first auger channel and said second auger channel, said wall member having an opening in said wall member, disposed adjacent to a pumping section having a second predefine volume of developer material within said first auger channel, said opening providing a spillway from said first auger channel to said second auger channel to allow excess developer material to be re-circulated when said second predefine volume of developer material in said pumping section is substantially full, said first auger transports developer material at a first rate in a mixing section of said first auger channel, and transports developer material at a second rate in said pumping section of said first auger channel; said first transport rate being substantially greater than said second transport rate to maintain second predefined developer material volume in said pumping section substantially full when said first predefined developer material-volume in said sump is substantially less than full.

2. A developer system of claim 1, wherein said first auger includes:

a plurality of blades, wherein a first region of said plurality of blades associated with said mixing section have a first predefined blade pitch/diameter ratio for transporting developer material at said first rate and a second region of said plurality of blades associated with said pumping section have a second predefined blade pitch/diameter ratio for transporting developer material at said second rate.

3. A developer system of claim 2, wherein said first rate is about twice the second rate.

4. A developer system of claim 2, wherein said first predefined blade pitch/diameter ratio is between 1.2 to 0.2.

5. A developer system of claim 2, wherein said first predefined blade pitch/diameter ratio is between 0.8 to 1.1.

6. A developer system of claim 1, further comprising a pickup auger, for transporting developer material from said pumping section to said developer member.

* * * * *